United States Patent [19]

Lawrence

[11] 4,200,946

[45] May 6, 1980

[54] LOAD-SUPPORTING STRUCTURES

[75] Inventor: Derek I. Lawrence, Crewkerne, England

[73] Assignee: Westland Aircraft Limited, Yeovil, England

[21] Appl. No.: 961,204

[22] Filed: Nov. 16, 1978

[51] Int. Cl.[2] ..... E01D 9/00

[52] U.S. Cl. ..... 14/4; 52/693; 244/123; 14/17

[58] Field of Search ..... 14/3, 4, 6, 11, 12, 14/13, 17; 244/117 R, 119; 52/690, 693, 694; 428/902

[56] References Cited

U.S. PATENT DOCUMENTS

| | | | |
|---|---|---|---|
| 38,653 | 5/1863 | Briggs | 14/3 |
| 97,714 | 12/1869 | Smith | 14/3 |
| 1,880,480 | 10/1932 | Ragsdale | 52/694 X |
| 2,165,846 | 7/1939 | Gaisman | 14/73 |
| 2,385,142 | 9/1945 | Lank | 14/13 X |
| 2,467,558 | 4/1949 | Kapnek | 52/690 X |
| 3,181,187 | 5/1965 | Kahn | 14/73 |
| 3,302,361 | 2/1967 | Oudheusden | 14/73 X |
| 3,333,517 | 8/1967 | Kohler | 14/73 X |
| 3,394,419 | 7/1968 | Sedlacek | 14/13 |
| 3,551,237 | 12/1970 | Cox | 52/693 X |
| 3,591,995 | 7/1971 | Troutner | 52/693 |
| 3,646,725 | 3/1972 | Troutner | 52/693 X |
| 3,849,237 | 11/1974 | Zetlin | 14/73 X |
| 3,959,544 | 5/1976 | Rogers | 428/902 X |
| 4,025,675 | 5/1977 | Jowda | 428/902 X |
| 4,051,289 | 9/1977 | Adamson | 244/123 X |
| 4,102,108 | 7/1978 | Cody | 52/693 |

*Primary Examiner*—Nile C. Byers, Jr.

*Attorney, Agent, or Firm*—Larson, Taylor and Hinds

[57] ABSTRACT

A load-supporting structure comprises a plurality of similar longitudinally extending truss members each having upper and lower spaced-apart chords and intermediate joining members. The chords and joining members are constructed of rectangular tubular members, the joining members being arranged to overlap adjacent side surfaces of the respective chords which, in a preferred embodiment in which the tubular members are constructed of fibre-reinforced plastics material, provides large bond areas resulting in a strong lightweight structure.

The load-supporting structures of the invention find particular application in forming the individual trackways of a temporary bridge structure, means being provided for attaching structures end-to-end and to suitable ramp portions.

27 Claims, 10 Drawing Figures

20
22
21
21
21

21
A
24
25
26
23
23a

LOAD-SUPPORTING STRUCTURES

This invention relates to load-supporting structures, and particularly to such structures for use in the construction of permanent or temporary bridges.

Conventional temporary bridge structures such as used by the military to allow vehicular passage across obstacles are manufactured of light alloy or high strength steel which results in the structures being heavy. Since these temporary bridges must necessarily be transportable across rough terrain, the weight is a problem both in transportation and launching across the obstacle, and has been a limiting factor on the length of bridge that can be carried and consequently on the width of obstacle that can successfully be bridged. Existing bridges usually require a structural top decking in order to carry loads out to side members, and this results in a further weight penalty.

Accordingly in one aspect, the invention provides a load supporting structure comprising a plurality of similar longitudinally extending truss members, each truss member comprising upper and lower spaced-apart chords and intermediate joining members, the plurality of truss members being joined together in side-by-side relationship.

Preferably, the upper and lower chords and the joining members comprise rectangular tubular members. The rectangular tubular joining members may comprise vertical and diagonal members and may be arranged to lie to a nominal plane parallel and to one side of that of the upper and lower chords of that truss, side surfaces of the joining members overlapping adjacent side surfaces of the chords and being attached thereto.

In a preferred embodiment, the tubular members may be constructed of fibre-reinforced plastics material and the means of attachment may comprise bonding of adjacent surfaces. The upper chord may comprise two rectangular tubular members bonded side-by-side, each of said two members having a width of approximately one half of the width of the lower chord.

Bonded joints between the upper and lower chords and the joining members may be supplemented with metal gusset plates. In such an arrangement, the metal gusset plates may be rivetted to adjacent surfaces of the fibre-reinforced plastics chords, and may be rivetted and bonded to metal channel members that are rivetted and bonded to surfaces of the joining members.

Preferably, the fibre-reinforced plastics material is carbon-fibre reinforced material due to its high stiffness characteristic.

End fittings may be provided at each end of the structure so as to enable any desired number of the structures to be joined end-to-end. Conveniently, in a structure manufactured of rectangular tubular members, the end fittings may have a rectangular portion attached in the end of each assembled upper and lower chord and a protruding flange portion for attachment to mating flanges of fittings similarly attached to an adjacent structure. The mating flanges may be apertured for insertion of a metal pin to attach adjacent structures together. In a structure in which the rectangular tubular members are constructed of fibre-reinforced plastics material, the rectangular portion of the fitting may, preferably, be smaller than the internal dimensions of the chords, and metal wedges may be located in the spacings between adjacent surfaces.

An upper surface of the load supporting structure may be covered with a replaceable protective skin. The skin may comprise a layer of rubber and a corrugated metal sheet arranged, preferably, with the corrugations extending laterally of the structure.

In another aspect, the invention provides a method of producing a load supporting structure comprising the steps of cutting to length a number of rectangular tubular members, locating the members in the form of spaced-apart parallel chords and intermediate joining members, attaching adjacent surfaces of the chords and of the joining members to one another to form a truss member, locating a desired number of the truss members in side-by-side relationship to form a desired width of structure, and attaching adjacent surfaces of the truss members together to form said load supporting structure.

Preferably, the tubular members are manufactured of fibre-reinforced plastics material and the means of attachment includes bonding under pressure.

In yet another aspect, the invention provides a bridge structure having two parallel spaced-apart trackways each including at least one load-supporting structure comprising a plurality of similar longitudinally extending truss members, each truss member comprising upper and lower spaced-apart chords and intermediate joining members, the truss members fixedly attached to each other in side-by-side relationship.

The invention will now be described by way of example only and with reference to the accompanying drawings, in which.

Figures 1, 2:
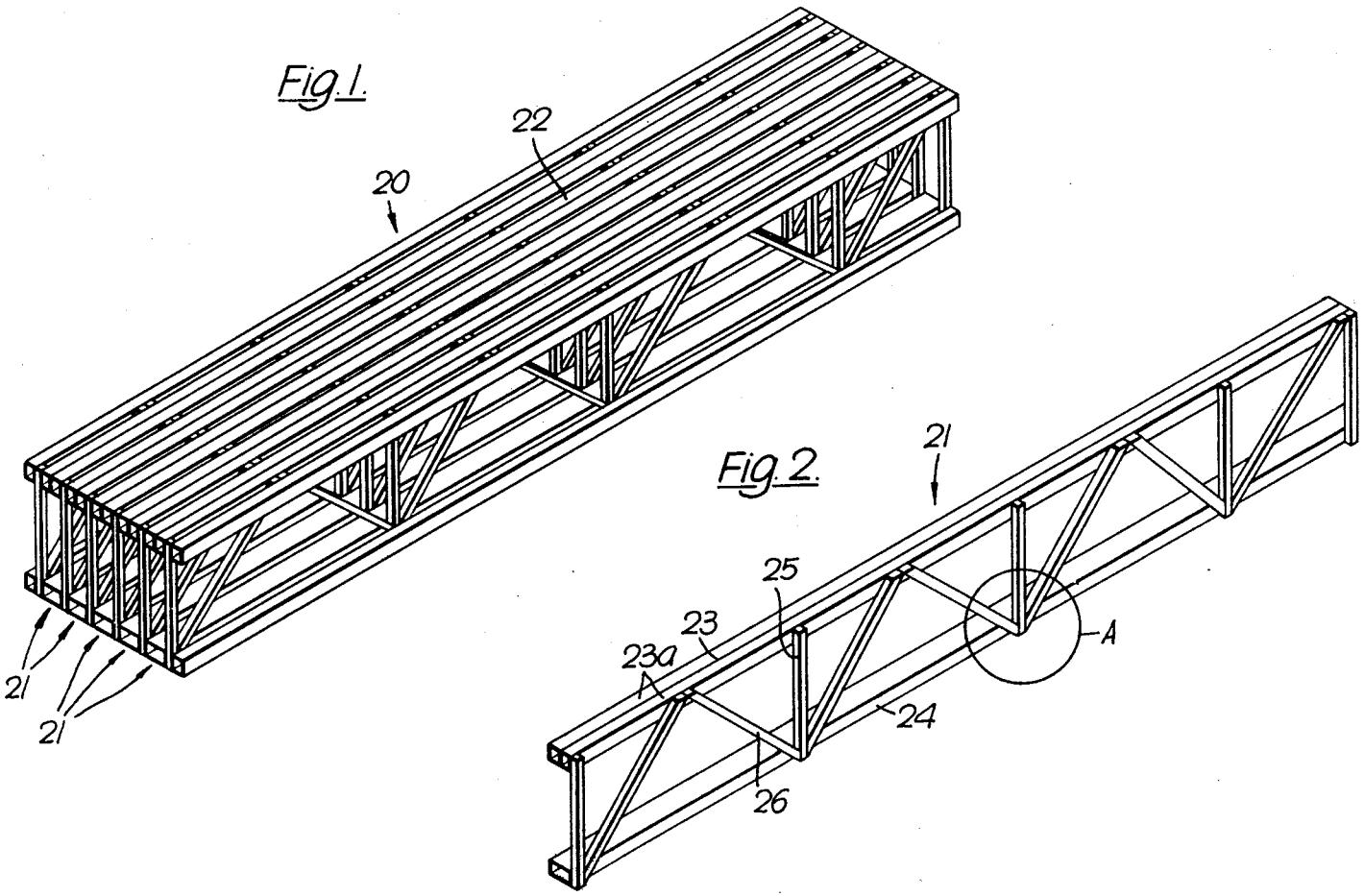
FIG. 1 is a perspective view of a load-supporting structure constructed in accordance with the invention.
FIG. 2 is a perspective view of one of the component parts of the structure of FIG. 1.

Referring now to FIG. 1, a load-supporting structure generally indicated at 20 comprises five longitudinally extending truss members 21 constructed of carbon fibre-reinforced plastics material and bonded together in side-by-side relationship so that an upper surface 22 forms a load-carrying trackway.

An individual truss member 21 is shown in FIG. 2, and comprises a bonded assembly having parallel spaced-apart upper and lower chords 23 and 24, respectively, and intermediate vertical and diagonal joining members 25 and 26 respectively.

Figure 3:
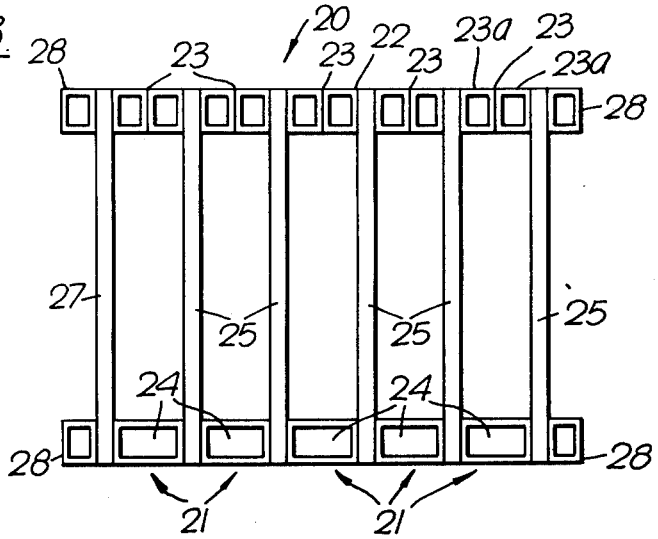
FIG. 3 is an end view of the structure of FIG. 1.

FIG. 3 is an end view of the structure of FIG. 1, showing the five individual truss members 21 bonded together. The upper and lower chords 23 and 24, respectively, and the vertical and diagonal joining members 25 and 26, respectively, are all of rectangular tubular cross section. A feature of the construction of this embodiment, best seen in FIGS. 2 and 3, is that the vertical and diagonal joining members 25 and 26 do not lie in the same nominal plane as the upper and lower chords 23 and 24, but lie in a nominal plane parallel and to one side of that of the chords so that side surfaces of the members and chords are in overlapping engagement and are attached to one another by bonding in the overlapping regions, resulting in large bond areas giving strong joints. In the particular embodiment shown, the upper chord 23 of each truss member 21 comprises two side-by-side rectangular tubular members 23*a* bonded together along their adjacent side surfaces to provide additional strength to the load-carrying trackway provided by the upper surface 22 of the structure.

It will be apparent that the structure 20 shown in the illustrated embodiment requires three sizes only of rectangular cross-section tubular members in its construction, the structure 20 comprising the assembled truss members 21 being completed at one side by further vertical and diagonal joining members 27 and by longitudinally extending members 28 at each corner of the transverse cross section. The members 27 are of similar dimension to the members 25 and 26, and the members 28 are of similar dimension to the members 23*a*.

Figure 4:
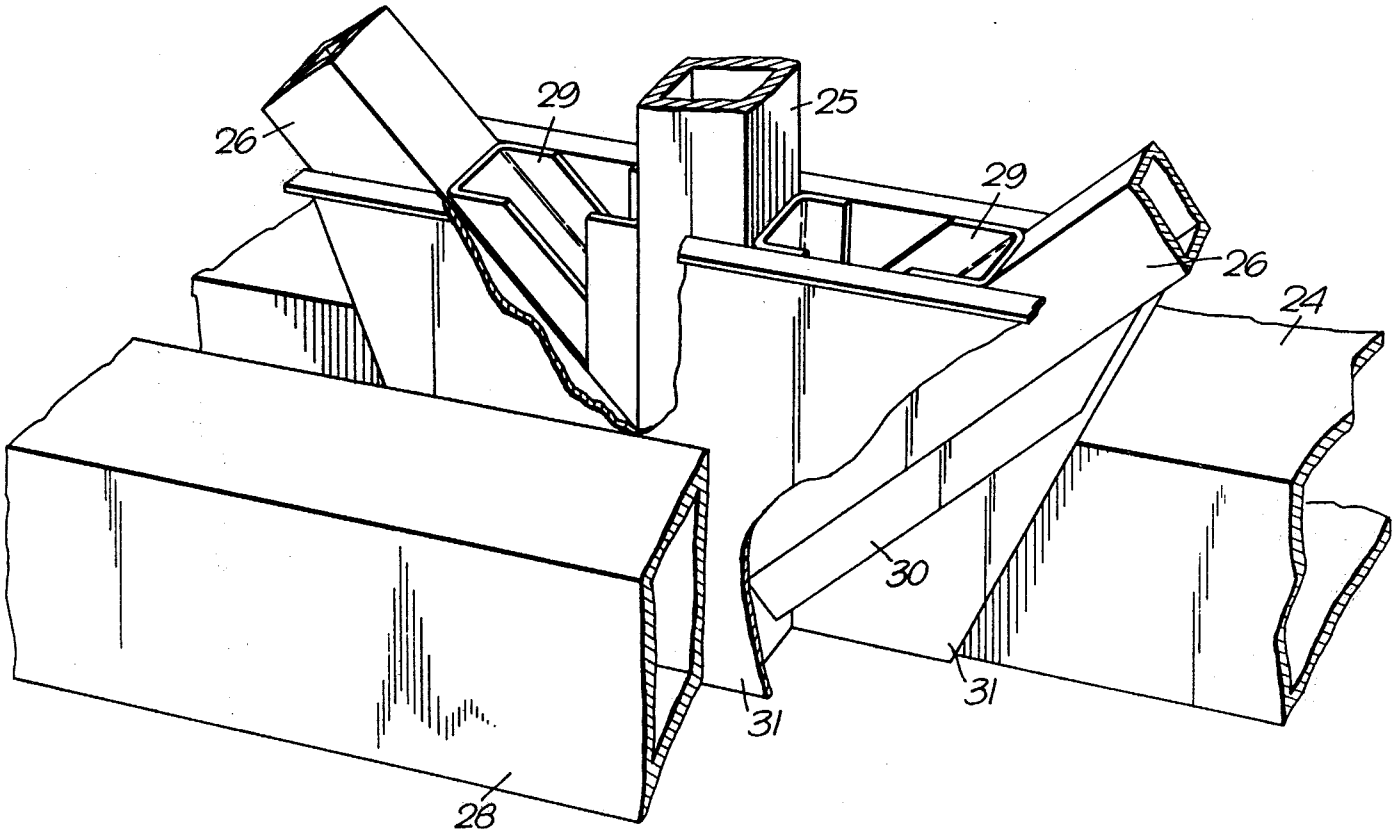
FIG. 4 is a perspective detail view on an enlarged scale of the area enclosed within circle A of FIG. 2.

In the illustrated embodiment, the bonded internal joints between the upper and lower chords 23 and 24 and the vertical and diagonal joining members 25 and 26 are supplemented by rivetted and bonded metal gusset plates as shown in FIG. 4. Light alloy channels 29 and 30 are bonded and rivetted to surfaces of the vertical and diagonal members 25 and 26, and a light alloy gusset plate 31 is located at each side of the joint and rivetted to flanges provided on the channels 29 and 30 and to the adjacent surfaces of the vertical and diagonal members 25 and 26, the lower chord 24 and the longitudinal member 28.

The various rectangular cross-section tubular members of the load-supporting structure are preferably manufactured by laying up alternate layers of longitudinally and diagonally extending carbon fibres pre-impregnated with a resin, on suitably dimensioned tools, and curing the assembly in a press at high temperature.

Figure 5:
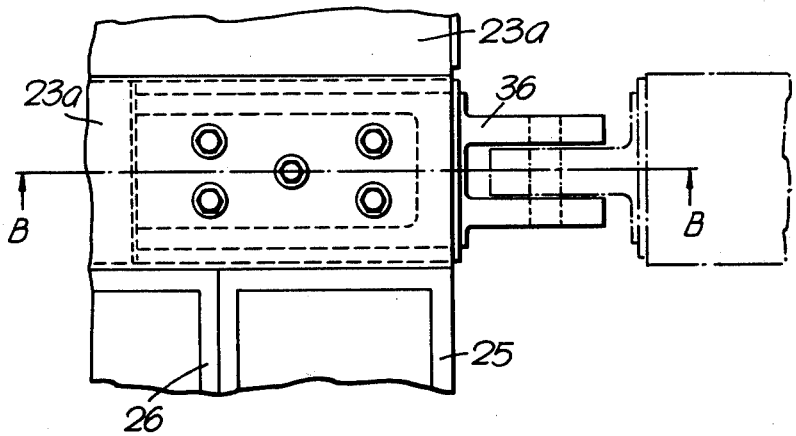
FIG. 5 is a detailed plan view of one end of the structure of FIG. 1, showing a method of joining such structures end to end.
Figure 6:
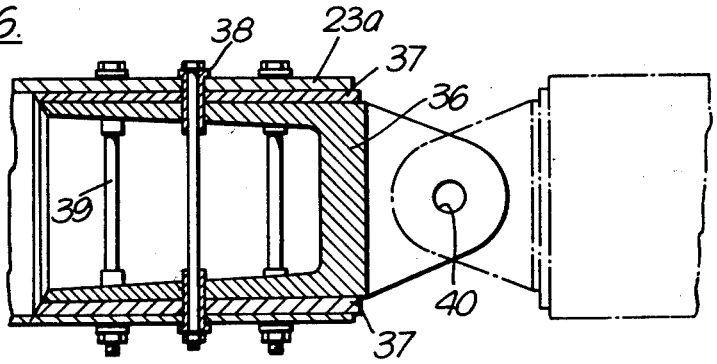
FIG. 6 is a sectioned side elevation taken on lines B—B of FIG. 5.

It has been found that this construction provides a light weight tube of high strength in which the longitudinal fibres carry the main tension and compression loads, and the diagonal fibres provide sufficient transverse stiffness to prevent local buckling. This is an important factor in the design since the width of the tubes is governed by the overall desired width of the structure, and their depth by the need to provide sufficient contact area for the internal joints. The use of diagonal fibres is very desirable in the regions of the internal joints to prevent local buckling and to diffuse stresses at these regions, and the use of diagonal fibres throughout the tubes means that mechanical fixings can be applied, without further reinforcement anywhere on the tubes, for instance at the ends of the tubes as shown in FIGS. 5 and 6.

In fabricating the structure from tubes formed as above described, the various tubes are cut to length and located as the upper and lower chords 23 and 24 and the joining members 25 and 26. Bonding adhesive is applied where required and the adhesive is cured with the assembly under pressure to form the truss members 21 shown in FIG. 2. A requisite number of truss members 21 to provide a desired width of structure 20 are then assembled side-by-side in suitable jigging and bonded under pressure to form the load-supporting structure 20. If fitted, the channels 29, 30 and the plates 31 at the internal joints (FIG. 4) are rivetted prior to curing the adhesive.

The load-supporting structure 20 exhibits high torsional and lateral stiffness without the need to provide additional elements for this purpose, which results in high structural efficiency and low weight. In preferred embodiments, the weight of the structure is minimised by the extensive use of fibre-reinforced plastics materials, and also by the construction technique in which internal joints are arranged so that the rectangular vertical and diagonal tubes are offset laterally of the rectangular horizontal tubes and have their opposite side surfaces bonded to adjacent side surfaces of the horizontal tubes, i.e., the vertical and diagonal joining members 25 and 26 do not lie in the same nominal plane as the upper and lower chords 23 and 24 but in one parallel thereto. This feature simplifies joint design.

The method of construction employed ensures that the width of the load-carrying structure 20 can be varied easily at the manufacturing stage, and the large joint areas provide for strong bonded joints. The construction provides a structure having multiple load paths resulting in the localization of any damage and a high damage tolerance before a significant failure occurs. Since three different sizes only of tubes are used, production is simplified and costs minimized.

In the illustrated embodiment, the dimensions of the tubular members may be as follows:

- upper chord (23*a*): 100 mm wide, 125 mm deep, upper surface 6.25 mm thick, lower surface 5 mm thick, outer side surface 4 mm thick, inner (joining) side surface 2.25 mm thick.
- lower chord (24): 200 mm wide, 125 mm deep, upper and lower surfaces 4.85 mm thick, sides surfaces 3.76 mm thick.
- vertical and diagonal members (25 and 26): 50 mm square, all sides 3.81 mm thick.

Five truss members 21 fabricated from tubes of these dimensions and used in the construction of the illustrated structure 20 give the latter a width dimension of approximately 1.5 meters. The structure may have a length of 7.5 meters and a depth of approximately 1 meter.

Figure 9:
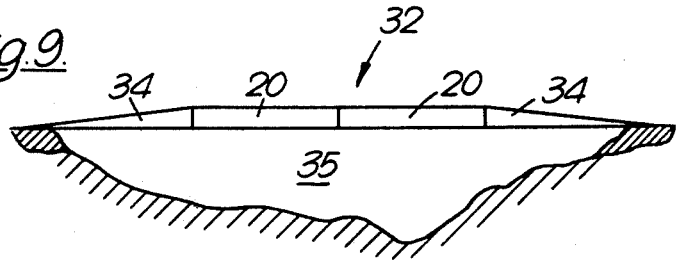
FIG. 9 is a side elevation of a temporary bridge incorporating load-supporting structures constructed in accordance with the invention.
Figure 10:
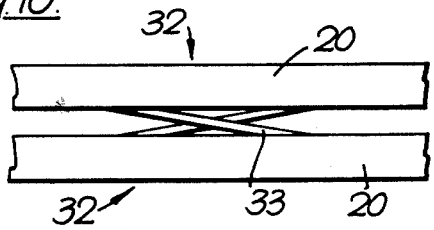
FIG. 10 is a fragmentary plan view of the bridge of FIG. 9.

The load-supporting structure 20 is ideally suited for many practical applications. One such application is in the construction of temporary bridges used to facilitate the passage of human and vehicular traffic over difficult and otherwise impassible terrain. An example of such a temporary bridge is shown in FIGS. 9 and 10, and comprises parallel spaced-apart trackways 32 interconnected by spacing members 33 arranged to permit a degree of relative movement of the trackways 32.

Each trackway 32 consists of two load-supporting structures 20 constructed as hereinbefore described, and two ramp portions 34, all joined end-to-end to provide a bridge having a 30 meter span sufficient to bridge a ravine 35. The ramp portions 34 are constructed of fibre-reinforced plastics material similar to the structures 20.

FIGS. 5 and 6 illustrate one means of joining the structures 20 end-to-end, and is shown in relation to the joining of adjacent upper chords 23. A light alloy fitting 36 has a rectangular end portion of smaller dimension than the interior of the tubular member 23*a* and is located in the tubular member 23*a* by light alloy wedges 37 treated with a suitable adhesive, the wedges serving to establish a suitable pressure to achieve a good bond.

Mating holes are then drilled through opposed surfaces of the assembly, and nylon bushes 38 inserted in the holes. Bolts 39 are located through the bushes 38 and secured by nuts, and the assembly is completed by curing the adhesive.

A flanged outer portion of the fitting 36 provides location for a mating flange formed on a similar fitting secured in each member 23*a* of an adjacent structure 20, and a steel pin (not shown) is located through mating holes 40 in the flanges to secure adjacent structures 20 end-to-end.

The attachment at the ends of adjacent lower chords 24 of end-to-end located structures 20 is similar to that described in relation to the upper chords 23, except that the fittings are suitably sized to mate with the larger interior dimension of the lower chord 24, and the protruding portion of the fitting is provided with a double flange attachment.

Figure 7:
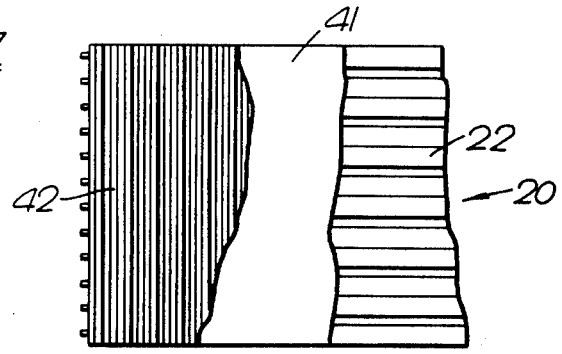
FIG. 7 is a fragmentary plan view of one end of the structure.
Figure 8:
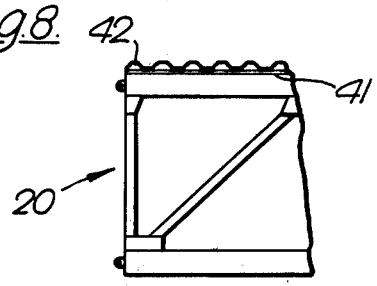
FIG. 8 is a side elevation of FIG. 7.

The high torsional and lateral stiffness of the structure 20 means that when used in the construction of a temporary bridge, no separate structural top deck is required. However, especially in a case in which the bridge is to be used for vehicular traffic, it is advisable to fit a replaceable protective skin as illustrated in FIGS. 7 and 8. A layer of rubber 41 is first laid on the load-carrying trackway provided by the upper surface of the structures 20, and is covered by a corrugated light alloy sheet 42 which is attached by bolting into tapped plugs (not shown) bonded in the upper ends of the vertical tubular joining members 25. The corrugations of the sheet 42 are arranged laterally of the trackway, and this feature together with the layer of rubber 41 serves to distribute at least a portion of the vehicle wheel loads to truss members 21 other than those directly beneath the wheel.

A temporary bridge constructed as hereinbefore described retains the benefits of light weight, strength and high damage tolerance attributed to the construction of the load-supporting structures 20, and the multiple upper and lower chords 23 and 24 provide direct and well distributed load paths into the end fittings 34, thus avoiding very highly loaded joints in these areas.

In a bridge as illustrated in FIGS. 9 and 10 and constructed from components of the dimensions described, the weight of each pair of the structures 20 of each trackway 32 including decking and end fittings is estimated at 1978 kg, which is about one half the weight of a comparable light alloy structure. Operationally, the low weight of the bridge provides important advantages over conventional designs, such as easier handling and launching and the possibility of reducing the weight and cost of a transporting vehicle and simplifying the launching equipment. Alternatively, the lesser weight of the bridge structure facilitates the transport of larger bridge structures by existing transporters so as to enable wider obstacles to be crossed than is presently possible.

It will be understood that many modifications can be made without departing from the scope of the invention as defined in the appended claims. For instance, the rectangular tubular members could be manufactured of metal instead of the carbon-fibre reinforced plastics material of the illustrated embodiment since, due to the constructional features, thin section tubing only would be required resulting in a lightweight metal structure having good strength characteristics. Alternatively, other fibre-reinforced plastics materials or a combination of metal and such materials could be used.

I claim as my invention:

1. A load supporting structure comprising a plurality of similar longitudinally extending truss members, each said truss member having upper and lower spaced-apart chords and intermediate joining members, wherein said upper and lower chords and said joining members are constructed of tubular material having a rectangular cross-section, said rectangular joining members of each truss being located in a nominal plane parallel and to one side of the upper and lower chords of that truss and so that one of the side surfaces of the joining members overlap one of the side surfaces of the chords and are attached thereto, said plurality of truss members arranged in side-by-side relationship so that the other one of the side surfaces of the upper and lower chords of a truss member overlap the other one of the side surfaces of the joining members of an adjacent truss member, fixedly attaching said plurality of adjacent members to each other so as to form the load supporting structure.

2. A load-supporting structure as claimed in claim 1, wherein said intermediate joining members comprise vertical and diagonal members.

3. A load-supporting structure as claimed in claim 1, wherein said upper and lower chords and said joining members are constructed of fibre-reinforced plastics material.

4. A load-supporting structure as claimed in claim 3, wherein said fibre-reinforced plastics material is carbon fibre-reinforced material.

5. A load-supporting structure as claimed in claim 3, wherein the means of attachment includes bonding of adjacent surfaces.

6. A load-supporting structure as claimed in claim 5, wherein the bonded joints between the upper and lower chords and the joining members are supplemented with metal gusset plates.

7. A load-supporting structure as claimed in claim 6, wherein said metal gusset plates are rivetted to adjacent surfaces of the fibre-reinforced plastics chords, and rivetted and bonded to metal channel members that are rivetted and bonded to surfaces of the joining members.

8. A load-supporting structure as claimed in claim 3, wherein each said upper chord comprises two rectangular tubular members bonded side-by-side, each of said two members having a width of approximately one half of the width of said lower chord.

9. A load-supporting structure as claimed in claim 1, having end fittings at each end of the structure to enable a plurality of said structures to be joined end to end.

10. A load-supporting structure as claimed in claim 1, having end fittings at each end of the structure to enable a plurality of said structures to be joined end to end, said end fittings have a rectangular portion attached in the end of each assembled upper and lower chord, and a protruding flange portion for attachment to mating flanges of fittings similarly attached to an adjacent structure.

11. A load-supporting structure as claimed in claim 10, wherein said mating flanges are apertured for insertion of a metal pin to attach adjacent structures together.

12. A load-supporting structure as claimed in claim 1, wherein said upper and lower chords are constructed of fibre-reinforced plastics material, said structure having end fittings at each end to enable a plurality of said structures to be joined end to end, each fitting having a rectangular portion attached in the end of each assembled upper and lower chord, the rectangular portion of said fitting being of smaller dimensions than the internal dimensions of said chord, metal wedges being located in the spacings between the facing surfaces.

13. A load-supporting structure as claimed in claim 1, having an upper surface covered with a replaceable protective skin.

14. A load-supporting structure as claimed in claim 13, wherein said protective skin comprises a layer of rubber and a corrugated metal sheet.

15. A load-supporting structure as claimed in claim 14, wherein the corrugations of said metal sheet extend laterally of said structure.

16. A method of producing a load-supporting structure comprising the steps of cutting to length a number of similar rectangular tubular members locating said members in the form of spaced apart parallel chords and intermediate joining members, attaching adjacent surfaces of said chords and of said joining members to one another to form a truss member such that the rectangular joining members are located in a nominal plane parallel and to one side of that of the upper and lower chords, locating a desired number of said truss members in side-by-side relationship to form a desired width structure, and attaching together with the abutting surface of the joining members of one truss to the abutting surfaces of the chords of another truss to form said load-supporting structure.

17. A method according to claim 16, wherein said tubular members are manufactured of fibre-reinforced plastics material, and the means of attachment includes bonding.

18. A method according to claim 17, wherein said bonded attachments are accomplished by bonding under pressure.

19. A structure having two parallel and spaced-apart trackways, each trackway including at least one load-supporting structure comprising a plurality of similar longitudinally extending truss members, each truss member comprising upper and lower spaced apart chords and intermediate joining members wherein said upper and lower chords and said joining members are constructed of tubular material having a rectangular cross-section, said rectangular joining members of each truss being located in a nominal plane parallel and to one side of that of the upper and lower chords of that truss so that one of the side surfaces of the joining members overlap one of the side surfaces of the chords and are attached thereto, said plurality of truss members being arranged in side-by-side relationship so that the other one of the side surfaces of the upper and lower chords of a truss member overlap the other one of the side surfaces of the joining members of an adjacent truss member, fixedly attaching said plurality of adjacent truss members to each other so as to form the load supporting structure.

20. A structure as claimed in claim 19, wherein said upper and lower chords and said joining members comprise rectangular tubular members.

21. A structure as claimed in claim 20, wherein said rectangular tubular members are constructed of fibre-reinforced plastics material.

22. A structure as claimed in claim 19, wherein a protective skin is provided on the upper surface of the upper chords of the assembled truss members.

23. A structure as claimed in claim 22, wherein said protective skin comprises a layer of rubber and a corrugated metal skin.

24. A structure as claimed in claim 19, wherein means are provided at both ends of the load-supporting structures to enable load-supporting structures to be joined end-to-end so as to selectively vary the length of each trackway.

25. A structure as claimed in claim 24, wherein said joining means also serve to join ends of the load-supporting structures to ramp portions provided at both ends of the trackways.

26. A structure as claimd in claim 24, wherein the joining means comprise mating apertured flange fittings protruding from the ends of the upper and lower chords of the load-supporting structures.

27. A structure as claimed in claim 19, wherein said spaced-apart trackways are interconnected by spacing members arranged to permit a degree of relative movement of the trackways.

* * * * *